US005226213A

United States Patent [19]

Lewis et al.

[11] Patent Number: 5,226,213

[45] Date of Patent: Jul. 13, 1993

[54] RAKE VALVE FOR AIR-FIBER STREAMS

[75] Inventors: James R. Lewis, Old Hickory, Tenn.; David E. Wilson, Poughkeepsie, N.Y.

[73] Assignee: E. I. Du Pont de Nemours and Company, Wilmington, Del.

[21] Appl. No.: 764,782

[22] Filed: Sep. 24, 1991

[51] Int. Cl.[5] ..... D01G 23/08; B65G 51/12; F15D 1/14; F16K 1/20

[52] U.S. Cl. ..... 19/66 R; 19/205; 19/296; 19/304; 137/832; 138/37; 251/301; 406/1; 406/159; 406/183

[58] Field of Search ..... 19/0.27, 65 R, 65 A, 19/66 R, 66 CC, 144, 145.5, 200, 204, 205, 300; 209/19, 20, 139.1, 615, 135, 143, 644, 695; 137/803, 814, 832, 861, 872; 138/39, 37, 40

[56] References Cited

U.S. PATENT DOCUMENTS

| | | | |
|---|---|---|---|
| 655,299 | 8/1900 | Eberhardt | 19/205 X |
| 671,402 | 4/1901 | Schuman | 406/154 |
| 1,593,965 | 7/1926 | Cobb | 19/200 X |
| 2,057,369 | 10/1936 | Curley | 19/205 X |
| 3,326,609 | 6/1967 | Auten et al. | 302/28 |
| 3,768,120 | 10/1973 | Miller | 19/156.3 |
| 3,851,925 | 12/1974 | Roberson | 302/28 |
| 4,103,397 | 8/1978 | Jackson | 19/66 CC |
| 4,365,389 | 12/1982 | Beneke et al. | 19/205 X |
| 4,476,611 | 10/1984 | Keller et al. | 19/105 |
| 4,514,881 | 5/1985 | Hergeth et al. | 19/80 R |
| 4,864,693 | 9/1989 | Pinto et al. | 19/105 |
| 4,866,815 | 9/1989 | Lucassen et al. | 19/205 |
| 4,977,645 | 12/1990 | Hösel | 19/200 |

FOREIGN PATENT DOCUMENTS

| | | | |
|---|---|---|---|
| 1510388 | 1/1972 | Fed. Rep. of Germany | 19/205 |
| 3628380 | 12/1987 | Fed. Rep. of Germany | 406/181 |
| 2096190 | 10/1982 | United Kingdom | 19/205 |

*Primary Examiner*—Clifford D. Crowder
*Assistant Examiner*—Ismael Izaguirre

[57] ABSTRACT

A maintenance-free valve for impeding the flow of fibers in a high velocity air-fiber stream. The valve has a rake-like construction to impede fiber flow when in the closed position. The valve has a plurality of closely-spaced, parallel tines attached to a rotatable shaft that is perpendicular to the tines. When closed, fibers collect on the tines of the rake valve, blinding the valve to further fiber flow. When opened, the fibers are dislodged from the tines such that they re-enter the air-fiber stream.

6 Claims, 3 Drawing Sheets

RAKE VALVE FOR AIR-FIBER STREAMS

BACKGROUND OF THE INVENTION

The invention relates to an apparatus for impeding the flow of fibers in a high velocity air stream. More particularly, the invention relates to a valve having a rake-like construction for impeding fiber flow when in the closed position.

DESCRIPTION OF THE RELATED ART

During the manufacture of various air-laid nonwoven fabrics (e.g., "Sontara" spunlaced fabrics commercially available from E. I. du Pont de Nemours & Co. Wilmington, Del.), it is necessary to convey staple fibers within a high velocity (i.e., typically greater than 30 ft/sec) air stream to various destinations. Uniformity of the resulting air-laid nonwoven fabric is dependent on one's ability to convey fiber to those destinations at controlled rates.

In the typical process for manufacturing air-laid nonwoven fabrics, staple fibers being conveyed in a high velocity air stream are diverted using conventional dampers, "Y-shaped" valves or pinch valves. Examples of some of these prior art dampers and valves are disclosed in U.S. Pat. Nos. 3,326,609; 3,768,120 and 3,851,925. While all of these valves have been widely used in the nonwovens industry, each has particular design flaws which cause unnecessary maintenance downtime. In particular, "Y-shaped" valves have a rotating drum which is in constant contact with the fiber stream. As a result, jams occur due to fiber buildup around the base of the drum. In contrast, pinch valves use an air cylinder to collapse a flexible duct across the air-fiber stream and prevent fiber flow. Extended use of pinch valves distorts the flexible duct section, adversely affecting the functionality of the valve.

Clearly, what is needed is an apparatus that does not have the problems and deficiencies inherent in the prior art. To this end, the applicants have discovered a solution to the aforementioned prior art problems wherein a valve having a rake-like construction is used to provide essentially maintenance-free operation. Other objects and advantages of the invention will become apparent to those skilled in the art upon reference to the drawings and the detailed description of the invention which hereinafter follow.

SUMMARY OF INVENTION

According to the invention, there is provided a valve for impeding the flow of fibers in a high velocity air-fiber stream. The valve has a rake-like construction (hereinafter "rake valve") to impede fiber flow when in the closed position. The rake valve has a plurality of closely-spaced, parallel tines attached to a rotatable shaft that is perpendicular to the tines. When closed, fibers collect on the tines of the rake valve, blinding the valve to further fiber flow. When opened, the fibers are dislodged from the tines such that they re-enter the air-fiber stream. Thus, it is the design and movement of the rake valve that allows it to be maintenance-free.

The rake valve is preferably installed in a rectangular duct section which is carrying an air-fiber stream. The rake valve contains a plurality of parallel tines (i.e., bars or teeth) similar to those of a rake. The rake valve is preferably mounted and hinged along the top portion of the duct so that the tines project vertically and downward when the valve is in the closed position. However, it will be understood that the rake valve may also be mounted and hinged in other positions within the duct (e.g., from the bottom or from the sides) without departing from the spirit of the invention. When the rake valve is closed, the tines collect fiber, which then blocks further passage of fiber and air through the valve and the duct. Upon opening the valve, so that the tines are parallel with the flow of the air-fiber stream, all the blocked fibers previously held on the tines slide off and re-enter the air-fiber stream. As a result of the rake valve design, fibers will not jam or collect around the valve (i.e., it is self-cleaning), nor is there damage to the valve or duct following repeated use.

As used herein, the term "closely-spaced" means that the parallel tines of the rake-valve are spaced no more than 3 inches apart when attached to the rotable shaft. If the tines are greater than 3 inches apart, staple fibers (normally averaging between 0.5 to 3 inches in length) will not collect between adjacent tines. Spacing is preferably uniform between adjacent tines, although this is not critical to the invention.

DETAILED DESCRIPTION OF THE PREFERRED EMBODIMENTS

In order to overcome the deficiencies inherent in prior art valves, the applicants have developed a new valve to provide essentially maintenance-free operation. The new valve employs a rake-like construction to impede fiber flow in an air-fiber stream when the valve is in the closed position. When an air-fiber stream contacts a closed rake valve according to the invention, the air will initially pass freely between the tines of the rake. However, the small tufts of staple fiber, will begin to collect on the rake tines and will eventually block the passageway (typically in 2–5 seconds) to other approaching fibers. To resume fiber flow, the tines of the rake valve are rotated upwardly, providing an unobstructed path for the air-fiber stream. Subsequent air-fiber flow cleans the rake valve thus preventing fiber buildup over time. The unique design allows fibers to be cleaned from the rake valve as the tines approach a parallel orientation with the flow of the air-fiber stream. As the tines are rotated upwardly, the fibers which have collected on the rake valve slide off the unattached end of the tines.

Figure 1:
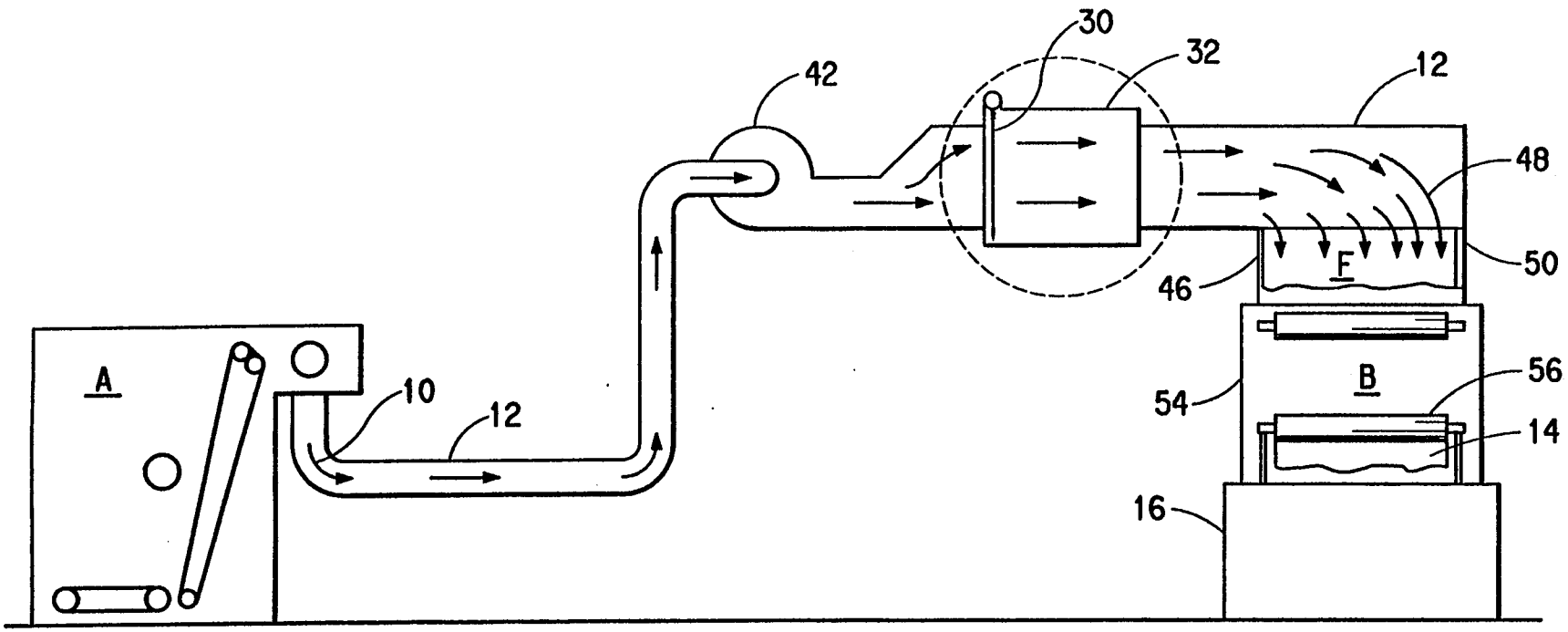
FIG. 1 is a schematic view of a standard flow-through fiber preparation feed system utilizing a rake valve according to the invention.

Referring now to the drawings, wherein like reference numerals designate like elements, a preferred embodiment of the rake valve in accordance with the present invention is shown in FIG. 1 as part of a standard flow-through fiber preparation feed system. FIG. 1 shows a lay down cross blender A which provides a source of blended fibers. Fibers can be supplied to blender A using a conventional or automatic bale opening system such as that described in U.S. Pat. No. 4,514,881. Fibers are delivered in the form of a fiber-laden airflow 10 from the blender to a vertical chute feed B through duct 12. The fiber-laden airflow 10 is formed and transported by fan 42 within duct 12. A rake valve 30 is positioned downstream of fan 42 and within a rectangular portion 32 of duct 12 in order to impede the flow of fibers within fiber-laden airflow 10. When rake valve 30 is in the closed position, air is allowed to initially pass through the tines of the rake while fiber flow is impeded. Thus, rake valve 30 can control the rate of fiber conveyance to various downstream destinations.

Once rake valve 30 is opened and fibers are conveyed downstream, the fibers are then compacted in the vertical chute feed and discharged in the form of a densified fibrous batt 14 which is then fed to an associated airlay web forming machine 16. Vertical chute feed B includes reserve section 46 which receives the fibers while the air from the fiber-laden airflow 10 exits in the direction of arrows 48 through an air exit 50 formed in a back wall of the section. As the air leaves the reserve section, fibers F are deposited in the transition or reserve section above a top feed roll 52. Top feed roll 52 feeds fibers into a fiber batt formation section 54 which discharges the fibers in the form of a densified, compacted fiber batt 14. The fiber batt is discharged by delivery rolls 56. The workings of the formation chute 54 are conventional and are disclosed in detail in U.S. Pat. No. 4,476,611.

Figure 2:
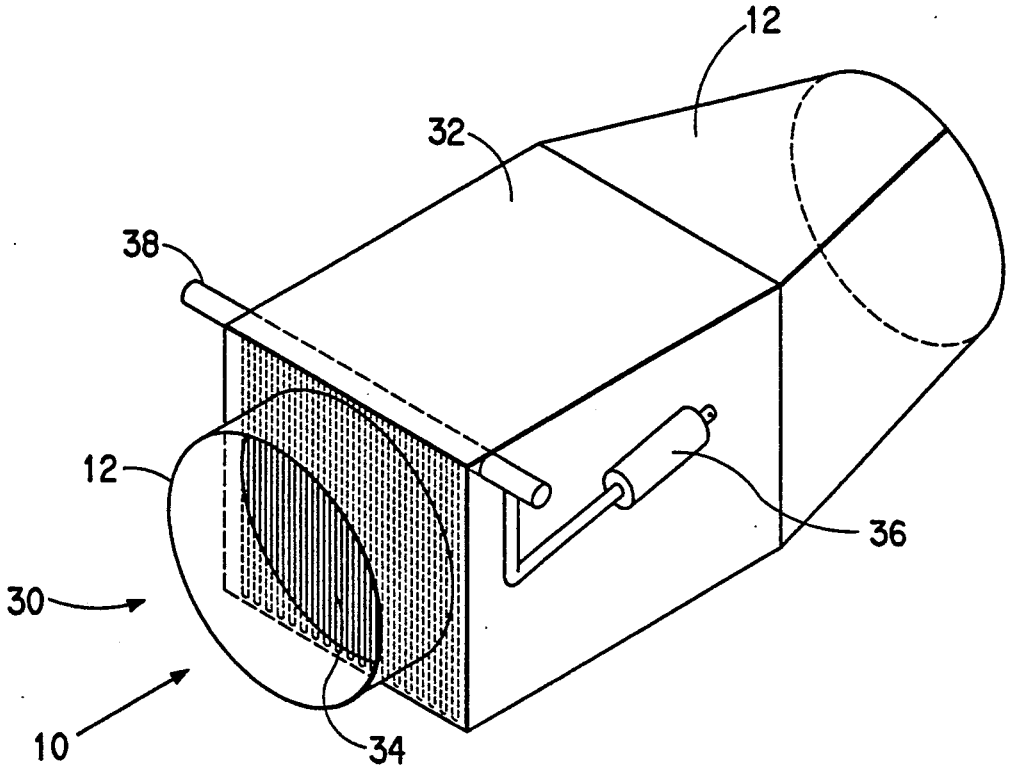
FIG. 2 is a schematic view of the inventive rake valve in the closed position within an air duct.

Referring now to FIG. 2, a longitudinal view of the inventive rake valve is shown of the section within the dotted circle in FIG. 1. In this view, the rake valve 30 is shown in the closed position. The rake valve comprises a rotatably hinged shaft 38 to which is perpendicularly mounted a plurality of parallel closely-spaced tines 34. The tines are spaced a short distance apart across the shaft (preferably about 0.625 inches for an average cut fiber length of about 0.875 inches) to allow air to pass freely but to catch fibers of longer length. In general, the tines should be spaced apart about 0.25 inches less than the average length of the cut fibers being conveyed. In a matter of seconds, the tines are completely blinded by fiber, and no further air passage is possible. As a result, the air is forced to carry fiber through an adjacent unimpeded duct (See FIG. 4).

The tines are preferably all the same length and are dimensioned so that they extend beyond the entrance area of the rectangular portion of duct 12. In the same manner, a sufficient number of tines are placed across shaft 38 so that they extend beyond the entrance area of the rectangular portion of duct 12. This dimensioning prevents fibers from passing beneath or around the individual tines when the rake valve is closed. Preferably, shaft 38 and tines 34 are fabricated of a hard polished material (most preferably polished 304 stainless steel) in order to provide a smooth surface for the fibers to slide off of when the valve is opened. The rake valve can be opened and closed manually or automatically. Typically, the rake valve is actuated by an air cylinder 36 which forces hinged shaft 38 to rotate clockwise or counterclockwise.

In use, fiber-laden airflow 10 enters a rectangular portion 32 of duct 12 and contacts the tines 34 of rake valve 30. Air continues to flow through the tines but fibers begin to collect on the tines eventually blocking the duct, typically within 2–5 seconds. Thereafter, air flow is no longer possible and the air-fiber stream is forced through an adjacent unimpeded duct.

Figure 3:
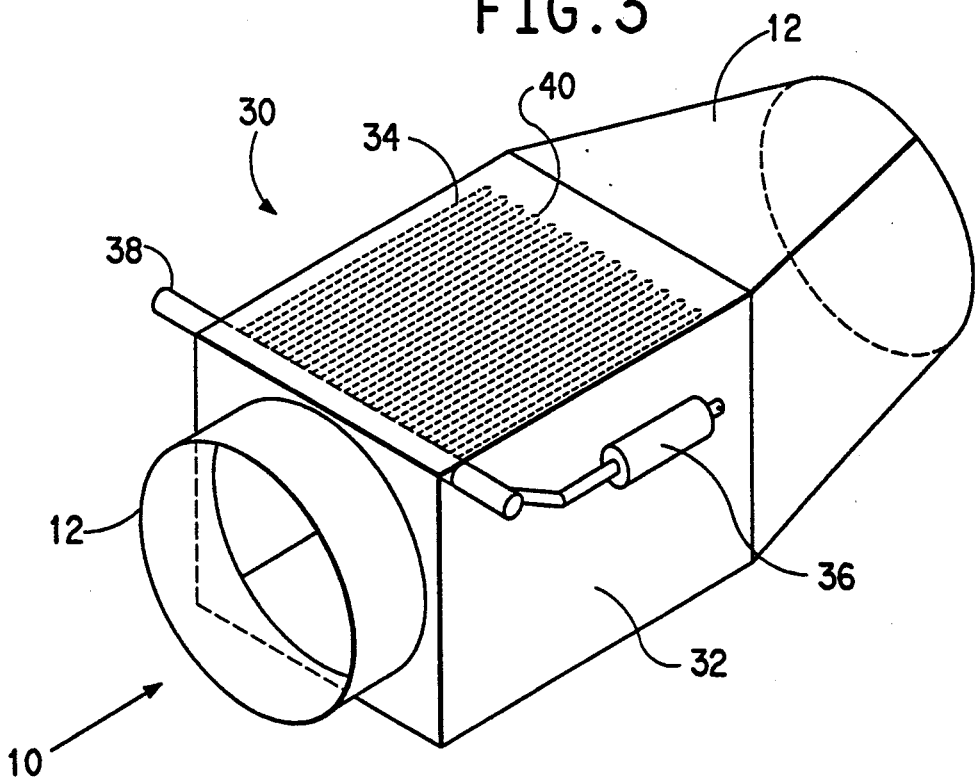
FIG. 3 is a schematic view of the inventive rake valve in the open position within the air duct of FIG. 2.

Referring now to FIG. 3, the rake valve 30 of FIG. 2 is shown in the open position. In this view, shaft 38 has been rotated counterclockwise by air cylinder 36 in order to move tines 34 from a vertical position to a horizontal position within rectangular portion 32 of duct 12. As the tines of the rake valve are rotated upwardly, an unobstructed path is created for the air-fiber stream 10. Subsequent air-fiber flow cleans the rake valve thus preventing fiber buildup over time. The tines allow fibers to be cleaned from the rake valve as the tines approach a parallel orientation with the flow of the air-fiber stream. As the tines are rotated upwardly, the fibers which have collected slide off the unattached ends 40 of the tines.

Figure 4:
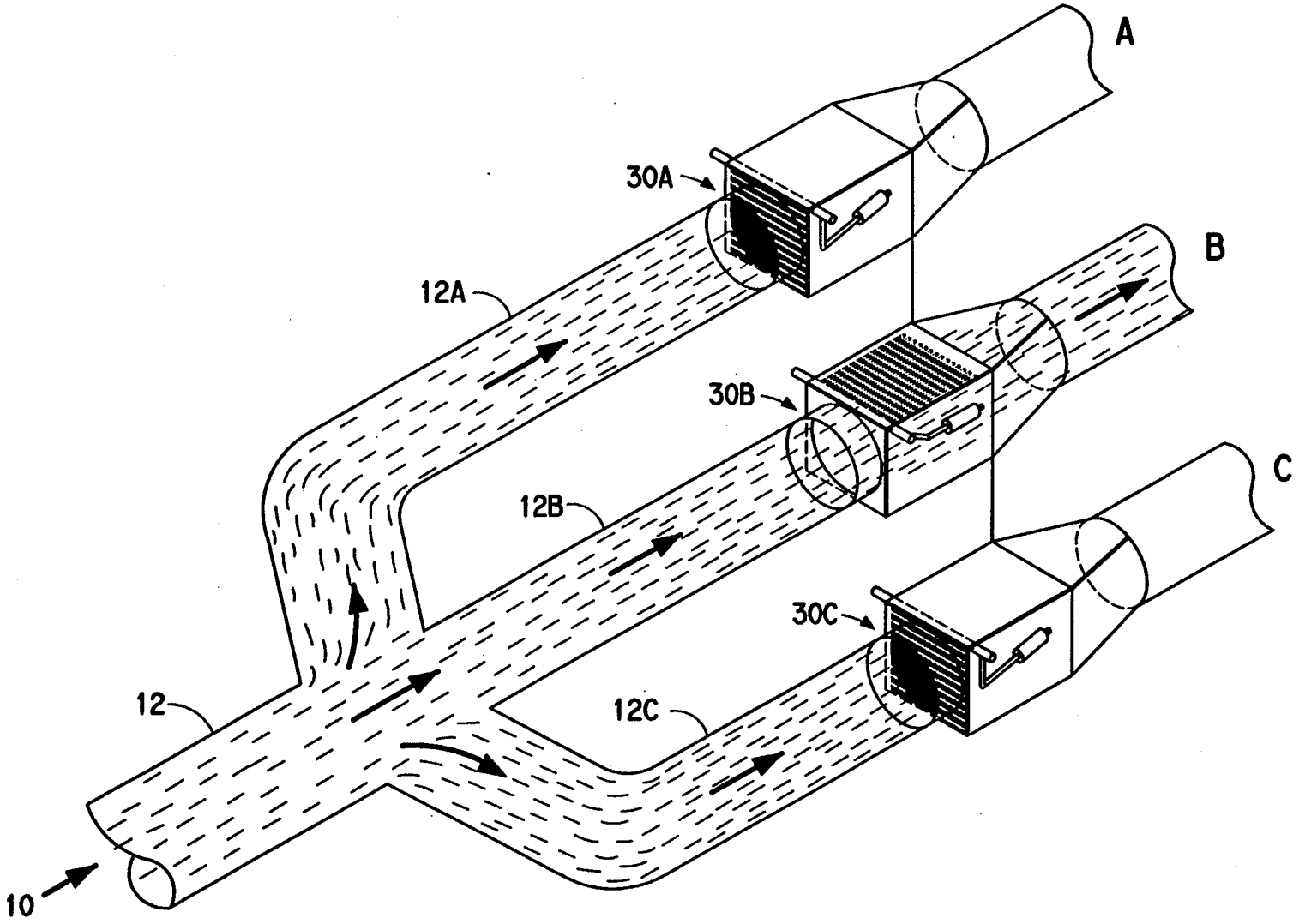
FIG. 4 is a schematic view of three inventive rake valves being used to divert an air-fiber stream in one of three different directions.

Referring now to FIG. 4, three adjacent rake valves 30A, 30B and 30C are shown wherein the fiber-laden airflow 10 is being diverted in one specific direction (Direction "B"). As shown in this Figure, fibers are being conveyed through a center duct 12B containing an open rake valve 30B. The two outer ducts 12A and 12C have been closed by rake valves 30A and 30C thereby prohibiting fibers from being conveyed downstream in Direction "A" or Direction "C". If the direction of conveyance was to be changed, one or possibly both of the outer rake valves (30A or 30C) would be opened as the center rake valve 30B was simultaneously closed.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A self-cleaning valve for blocking the flow of air and staple fibers being conveyed in a high velocity air/fiber stream when in a closed position, the valve comprising:

(a) a plurality of closely-spaced, parallel tines attached perpendicularly to a rotatable shaft; and (b) means for rotating the shaft during time periods when fibers and air are being conveyed in order to continuously place the valve in either an open or closed position;

such that when the valve is in a closed position the tines extend perpendicularly across the flow of air and fibers and collect fibers thereon until the tines are blocked to further passage of fiber and air; and such that when the valve is in an open position the tines are placed in parallel relation to the flow of air and fibers so that all blocked fibers previously held on the tines slide off and re-enter the flow of fibers being conveyed in the air/fiber stream.

2. The valve of claim 1 wherein the tines and shaft are fabricated of polished stainless steel.

3. The valve of claim 1 wherein the means for rotating the shaft is an air cylinder.

4. The valve of claim 1 wherein the tines are spaced about 0.625 inches apart.

5. The valve of claim 1 wherein the tines are substantially the same length.

6. A method of shutting down and starting up the flow of air and staple fibers being conveyed through a flow line as a high velocity air/fiber stream, the shutting down portion of the method comprising the steps of:

(a) closing a valve comprising:

(i) a plurality of closely-spaced, parallel tines attached perpendicularly to a rotatable shaft; and (ii) means for rotating the shaft in order to place the valve in an open or closed position, within the air/fiber stream by extending the tines of the valve perpendicularly across the flow of air and fibers and collecting fibers thereon until the tines are blocked to further passage of fiber and air; and (b) maintaining the valve in the closed position for a predetermined amount of time; and the starting up portion of the method comprising the step of:

(c) opening the valve by placing the tines in parallel relation to the flow of air and fibers and allowing all blocked fibers previously held on the tines to slide off and re-enter the flow of fibers being conveyed in the air/fiber stream.

* * * * *